US005638620A

United States Patent [19]

Van Der Kooy

[11] Patent Number: 5,638,620

[45] Date of Patent: Jun. 17, 1997

[54] DREDGING VESSEL, DREDGING ASSEMBLY AND METHOD OF DREDGING

[75] Inventor: Leendert Pieter Dirk Van Der Kooy, Meer, Belgium

[73] Assignee: Barrages Services International B.V., Netherlands

[21] Appl. No.: 443,656

[22] Filed: May 18, 1995

[30] Foreign Application Priority Data

May 18, 1994 [NL] Netherlands ..... 9400818

[51] Int. Cl.[6] ..... E02F 3/14

[52] U.S. Cl. ..... 37/338; 37/337; 37/341; 37/316

[58] Field of Search ..... 37/337, 338, 339, 37/340, 341, 316, 314, 312

[56] References Cited

U.S. PATENT DOCUMENTS

| | | | |
|---|---|---|---|
| Re. 11,873 | 11/1900 | McFadden | 37/338 X |
| 104,980 | 7/1870 | Mitchell | 37/338 |
| 117,109 | 7/1871 | Platt | 37/338 |
| 316,377 | 4/1885 | Marolle | 37/338 X |
| 461,193 | 10/1891 | Murphy | 37/338 |
| 660,956 | 10/1900 | Henderson | 37/337 X |
| 969,172 | 9/1910 | Lonney | 37/338 |
| 997,247 | 7/1911 | Ferris et al. | 37/338 X |
| 1,228,959 | 6/1917 | Oliver | 37/338 X |
| 1,584,277 | 5/1926 | Dec | 37/338 X |
| 1,762,794 | 6/1930 | Perry | 37/338 |
| 2,127,493 | 8/1938 | Tamerlane | 37/338 X |
| 2,147,062 | 2/1939 | Rosener | 37/338 X |
| 3,792,538 | 2/1974 | De Groot | 37/67 |
| 3,804,177 | 4/1974 | Renfroe | 172/26.5 |
| 3,874,101 | 4/1975 | Cummins | 37/338 |
| 3,943,644 | 3/1976 | Walz | 37/69 |
| 3,955,294 | 5/1976 | Morgenstein | 37/338 X |
| 3,999,313 | 12/1976 | Andrews | 37/338 X |
| 4,242,814 | 1/1981 | Fluks | 37/337 X |
| 4,302,893 | 12/1981 | van den Elshout et al. | 37/337 X |
| 5,237,949 | 8/1993 | Stevens et al. | 114/265 |

FOREIGN PATENT DOCUMENTS

| | | | |
|---|---|---|---|
| 1259635 | 9/1989 | Canada | E02F 5/30 |
| 2417545 | 10/1975 | Germany . | |
| 98068 | 5/1961 | Netherlands . | |
| 7903974 | 11/1980 | Netherlands | E02F 9/06 |
| 8901498 | 1/1991 | Netherlands | E02F 9/06 |
| 450932 | 7/1936 | United Kingdom . | |

*Primary Examiner*—Terry Lee Melius
*Assistant Examiner*—Victor Batson
*Attorney, Agent, or Firm*—Webb Ziesenheim Bruening Logsdon Orkin & Hanson, P.C.

[57] ABSTRACT

The present invention discloses a dredging assembly which includes a vessel having at least one opening therein. A dredging pole of a predetermined length is positioned in and extends through the opening and is positioned substantially perpendicular to the vessel when in the dredging position. A dredging wheel is positioned at the lower end of the dredging pole with a vertically movable tension wheel at an upper end of the dredging pole and a reversing wheel spaced horizontally from the dredging pole. An endless cable is mounted on the dredging pole extending around the tensioning wheel, dredging wheel and reversing wheel and a plurality of the scoops are mounted on the endless cable, wherein the scoops are turned upside down by the reversing wheel for dumping the material carried therein.

9 Claims, 3 Drawing Sheets

DREDGING VESSEL, DREDGING ASSEMBLY AND METHOD OF DREDGING

BACKGROUND OF THE INVENTION

1. Field of the Invention

The invention relates firstly to a dredging assembly and more particularly to a dredging assembly which serves to be used at difficult to access waters such as reservoirs in or behind mountain ranges.

2. Description of the Prior Art

Silting up of deep reservoirs, for example, can cause problems, such as environmental danger and can lead to the blocking of rivers, and of installations in or near the reservoirs.

Presently, sludge from the beds of these types of waters are mainly dredged up by sucking up the bed sludge which is subsequently transported away. A first problem here is that a lot of water is sucked away with the sludge, for instance 7 parts water to 1 part sludge is not unusual. This has of course a negative influence on the water level and/or on the amount of dredged up sludge to be transported away.

Sludge dredging by suction at depths of roughly 50 meters is also not able to be carried out with a great deal of accuracy since the suction pipe has the tendency to suck up everything that it comes into contact with.

Dredging assemblies are know from the Dutch patent application 7903974, the British patent application 450932, the Canadian patent 1259635 and the German Offenlegungsschrift 2417545.

However these assemblies are not suitable for dredging at depths of about 50 meters for example and suffer the same problem as suction dredging in that a great deal of water is removed along with the dredged up material.

A further problem is the accompanying logistics of the transporting to and assembling of such dredging systems at difficult to access stretches of water.

An object of the present invention is to provide a dredging assembly which substantially obviates at least one of the above mentioned problems.

SUMMARY OF THE INVENTION

The present invention provides, according to a first aspect, a dredging assembly comprising a vessel and dredging means, wherein the dredging means comprise a support of predetermined length, an endless cable mounted on the support, collecting means in the form of a predetermined number of scoops mounted on the endless cable for collecting sludge or the like, wherein the support is mounted substantially perpendicular to the vessel, when in position for dredging.

Since the support is mounted substantially perpendicular to the vessel when in position for dredging, the whole weight of the support bears down onto the particular scoop in contact with the bed. This enables effective, accurate dredging to be carried out at relatively deep depths, such as 60 meters.

Material, to be dredged, is furthermore compressed and compacted into the scoops whereby substantially no area is left therein, wherein large amounts of water could be brought up with the dredged material.

The present invention provides according to a second aspect a vessel for mounting a dredging pole, comprising: at least two components of such forms that they can be disassembled, independently from each other transported, and reassembled at a desired location, at least one opening through which the dredging pole or such like can be mounted, and rotation means for rotating the vessel at a predetermined location.

The present invention furthermore provides a method for dredging up material at depths of about 60 meters at difficult to access stretches of water and a dredging means.

BRIEF DESCRIPTION OF THE DRAWINGS

Further characteristics, advantages and details of the present invention will become clear in light of the following description which refers to the accompanying figures which show.

DESCRIPTION OF THE PREFERRED EMBODIMENTS

Figure 1:
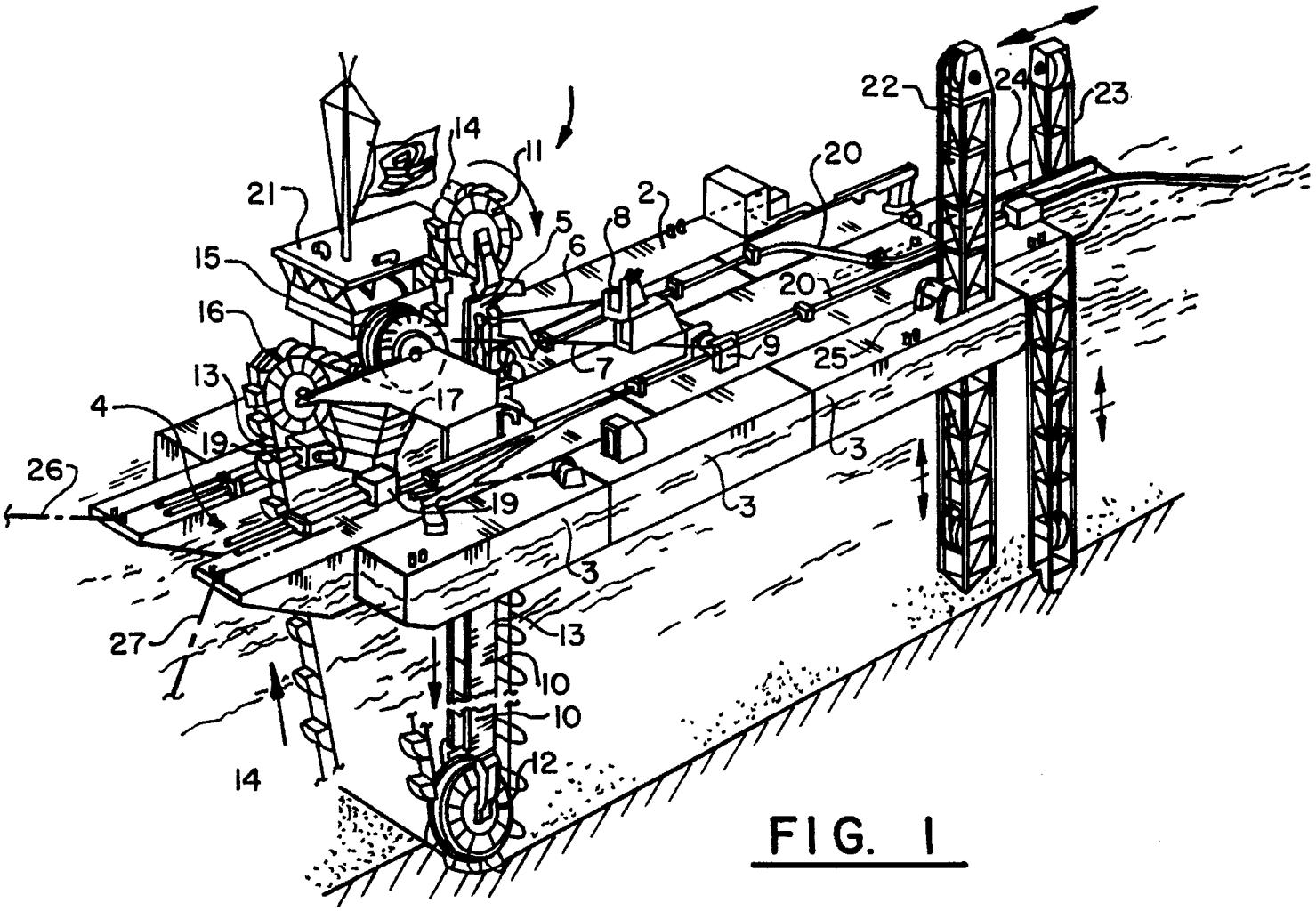
FIG. 1 a perspective view of a dredging assembly according to the present invention.

A dredging assembly 1 (FIG. 1) comprises a vessel 2 which in turn comprises pontoons 3 and a hopper dredge 5 mounted in a rear opening 4 of the vessel 2, which in this case will be called a dredge pole. In this preferred embodiment of a vessel 2 seventeen pontoons each having a maximum weight of 30 tons are brought together in order to form a vessel having a length of roughly 55 meters and a width of roughly 15 meters. If so desired, the dredging assembly 1 can be disassembled wherein the pontoons 3 and the dredge pole 5 can be transported independently from each other to difficult to access stretches of water such as mountain reservoirs, wherein the dredging assembly 1 can be reassembled at this desired location. The pontoons 3 have such a form that the setting up of the dredging assembly only requires a minimum of aid from the local population and equipment. The weight of the assembly is above 550 tons.

The dredge pole 5 is vertically and horizontally moveable and securable in an opening 4 of the vessel 2, by utilization of the cables 6 and 7. The winches 8 and 9 take care of the tilting of the dredge pole 5 to or from a horizontal position for maintenance, repairs, mounting and such like of the underwater components of the pole.

The dredge pole 5, which preferably has a length of between 50 and 60 meters is preferably formed from sections 10 which each have a length of about ten meters. Furthermore the dredge pole 5 has a vertically moving top tensioning wheel 11 which can be used in order to adjust the tension in an endless chain 13 and a dredge wheel 12 about which the chain 13 is guided on which scoops, referred to here as buckets, 14 are secured. The bucket chain 13 is driven by a drive wheel 15 around the dredge pole 5.

During dredging, the buckets 14, which preferably have sharpened cutting edges, are brought into contact with the bed by the dredge wheel 12. The buckets 14 are subsequently guided back to the vessel by the bucket chain 13 where the buckets 14 are tipped over by a chain reversing wheel 16 in order to unload their contents into a hopper 17, whereafter the buckets are guided back to the bed via the drive wheel 15 and top tensioning wheel 11 by the bucket chain 13.

Accordingly dredged up material is dumped into the hopper 17 substantially in a dry state whereby the water level of, for example, a reservoir, can be maintained at a roughly constant level.

The top tensioning wheel 11, drive wheel 15 and chain reversing wheel 16 are preferably arranged as shown in FIG. 1 so that on emptying of the scoops, material does not drop out of one scoop into another to yield optimum dredging conditions.

Each bucket 14 can have a number of holes 18 (see FIG. 2) through which water, which may have been brought up with the dredged material, flows away. As shown in FIG. 3, the scoops preferably have a tapered opening, whereby the front edge 40 and side edges 41 of the scoop are provided with cutting surfaces to optimize dredging efficiency.

Dredged up material is subsequently led from the hopper 17 to in preference two Putzmeister pumps 19 in order to be pumped away to the shore line via in preference pipe lines 20.

Dredged up material can also be transported away by a conveyor belt transporter for example.

The vessel 2 further comprises a cabin 21, a securing pole 22 and an anchor pole 23 which both have a length of roughly 60 meters. The anchor pole 23 is both vertical and to about 6 meters horizontally moveable in a fore opening 24 of the vessel 2 and securably in the fore opening 24 by a winch and cable system (not shown). The securing pole 22 is secured and is vertically moveable by an other winch and cable system 25. The securing pole 22 keeps the vessel in position during displacement of the anchor pole 23 to a new stroke.

During dredging the vessel 2 is held in position by means of two anchor lines 26, 27 mounted on the rear end of the vessel 2 and the securing pole 22 and anchor pole 23 which are embedded in the bed.

The dredge area is determined by positioning the dredge wheel 12. The dredge area can be changed laterally in order to comprise a circle shaped bed area vertically and horizontally.

Positioning of the dredge wheel 12 is carried out by adjusting the positions of the dredge pole 5, the anchor pole 23 and the vessel 2 itself by means of to and fro pulling between the extending anchors (comparable to the working of a cutter). The lateral dredge area is changed by releasing the anchors from the rear lines 26, 27 and raising the anchor pole 23 so that the vessel is now secured to the bed by the securing pole 22. By stearing the motors (not shown) of the vessel 2, the vessel can be rotated about the securing pole 22 in order to reposition the vessel 2 without loosing it reference location.

In another (not shown) embodiment of the dredging assembly according to the present invention, the vessel may be anchored to the sea bed by an anchor pole and arced over the area to be dredged by motors, associated with two rear anchor lines, which alter the length thereof, so that the dredge pole, as in the above described embodiment, is dragged sideways, slightly slanted, whereby the great weight of the dredge pole bears directly down on the scoops cutting into the bed due to the substantially vertical arrangement of the dredge pole, whereby the scoops not only cut into the bed on their front edges, but also cut into and dredge material therein due to the side cutting edges and the tapering form of the scoops, as shown in FIG. 3 which aids in dredging material from the bed.

In this embodiment of the present invention, dredging is mainly carried out by the side-edges of the scoops as the dredge pole is dragged across the bed, whereby the scoops gradually fill with material, whereby compressing of the material in the scoops is maximized to reduce the amount of water brought up by the scoops. In this embodiment, the scoop simultaneously act as a sort of combination of a miller and cutter.

Accordingly it is possible with this controlled guided movement of the vessel 2 and the dredge pole 5 to accurately dredge a predetermined bed profile. In this embodiment of the present invention, dredging can be carried out up to a maximum depth of about 60 meters. The dredging assembly 1 can be used in order to dredge up and pump away about 50.000 $m^3$ of material a week without the water level of a reservoir for example being lowered to any extent, since reservoir area is effectively created which can now be filled by "new" water flowing into the reservoir. Accordingly in use it is possible to position the vessel and simultaneously to determine the dredging depth in order to yield a bed dredge profile. This profile can thus be compared with a previous overview and if necessary can be adjusted.

Figure 2:
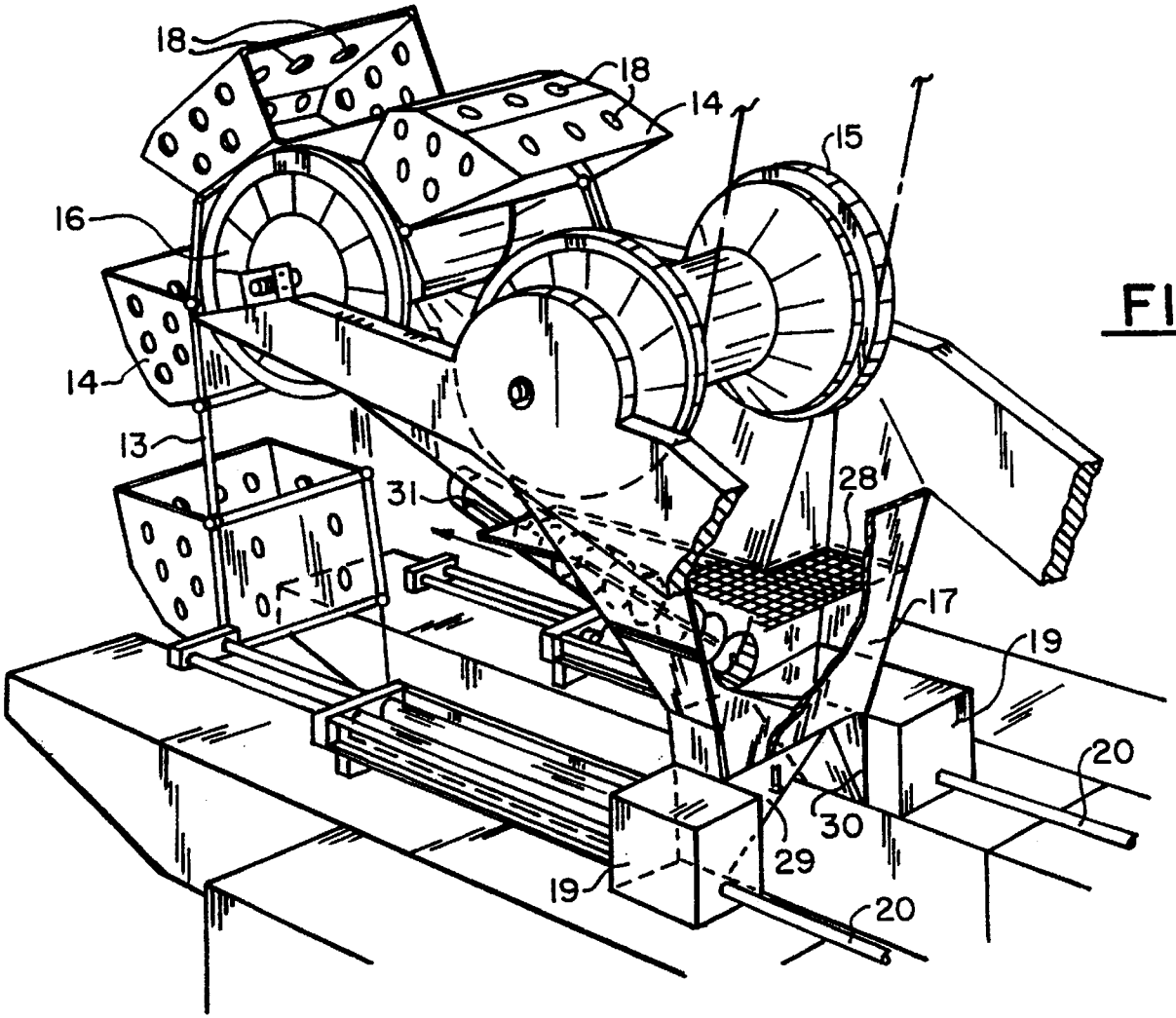
FIG. 2 a partly broken away perspective view of the chain buckets from FIG. 1, when these are being emptied.
Figure 3:
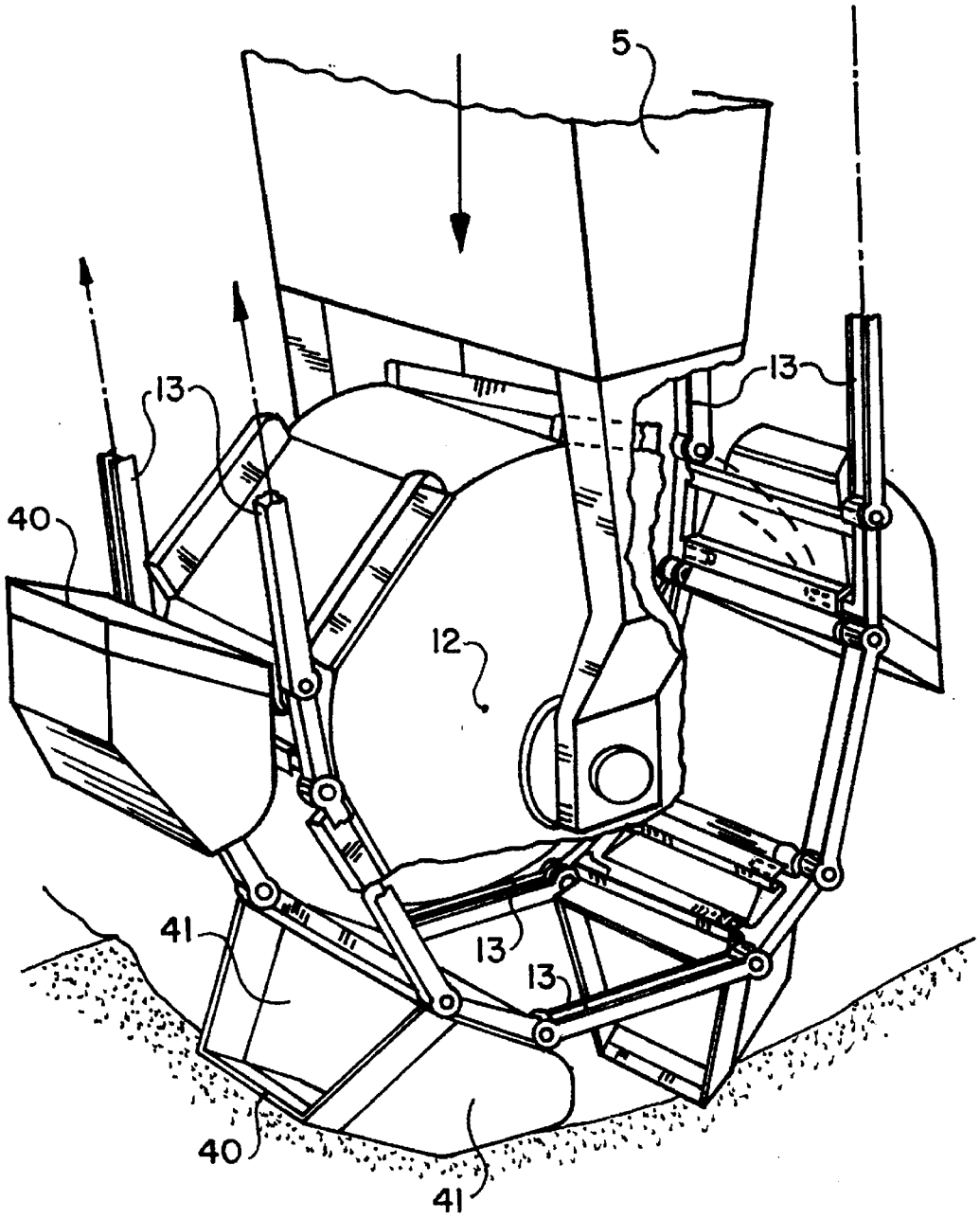
FIG. 3 a perspective view of the scoops collecting material.

Since the bucket chain 13 is preferably driven over the upper side of the chain tensioning wheel 16 and under the drive wheel 15, the buckets are tipped over in order to empty their contents in to the hopper 17 (see FIGS. 1 and FIGS. 2). Utilizing a chain tensioning wheel 16 in order to tip over the buckets 14, makes it possible to empty the buckets 14 without hindering the draft of the vessel and/or dredge pole 5. A grid 28 (FIG. 2) is positioned above the hopper 17 in order to prevent obstructions, such as rocks or such like dredged up along with material, from falling into the hopper 17, whereby the hopper 17 and/or the pumps 19 could become blocked. Material in the hopper 17 is guided into the two pumps 19 via two canals 29 and 30, the material thereafter being pumped away to the shore line by the pipe lines 20.

The hopper 17 can be pulled back via a pulling member 31 in order to facilitate access to the hopper 17 and the pumps 19 in order to clean and/or repair these for example. By displacement of the hopper 17, the grid 28 can be cleaned and/or removed in order to dislodge material stuck in the grid 18 for example.

The requested rights are in no way limited by the above shown and described embodiments of the present invention. It is for example conceivable that the dredge assembly could work completely on anchors so that the securing pole 22 and the anchor 23 are not needed. The requested rights are in the first instance determined by the following claims within the scope whereof many modifications are possible.

I claim:

1. A dredging assembly comprising: a vessel having at least one opening;

a dredging pole of a predetermined length positioned in and extending through said opening and positioned substantially perpendicularly to said vessel when in a dredging position;

a dredging wheel at a lower end of said dredging pole;

a vertically movable tensioning wheel at an upper end of said dredging pole;

a reversing wheel spaced horizontally from said dredging pole;

an endless cable mounted on said dredging pole extending around said tensioning wheel, said dredging wheel and said reversing wheel; and a plurality of scoops mounted on said endless cable, wherein said scoops are turned upside down by said reversing wheel for dumping of material carried therein.

2. The dredging assembly according to claim 1, wherein the position of said dredging pole is adjustable with respect to said vessel.

3. A dredging assembly according to claim 1, wherein said vessel includes at least two pontoons attached together wherein said pontoons are adapted to be disassembled, transported independently from each other, and reassembled at a desired location and further including rotation means for rotating said vessel at a predetermined location.

4. The dredging assembly according to claim 3, wherein each said scoop includes a predetermined number of holes associated with each scoop.

5. The dredging assembly according to claim 4, wherein each said scoop has a cutting surface associated with at least one edge of a scoop opening, and wherein said scoop opening tapers out towards said endless cable.

6. The dredging assembly according to claim 3, wherein said rotation means include at least one spud-pole of predetermined length on said vessel.

7. The dredging assembly according to claim 6, wherein said rotation means include the combination of at least two anchor lines, said spud-pole and one anchor pole associated with said vessel.

8. The dredging assembly according to claim 1, wherein said dredging pole comprises at least two sections of predetermined length.

9. A method for dredging up material from a bed using a dredging assembly, the method comprising the steps of:

anchoring a vessel, extending a dredging pole through an opening in the vessel to the bed, wherein the dredging pole is substantially perpendicular to the vessel, driving an endless cable having a plurality of scoops mounted thereon around the dredging pole so that the scoops dig up the bed material, transporting the material to the vessel to a position spaced horizontally from the dredging pole where the scoops are emptied, and guiding the now empty scoops back by the endless cable to the bed in order to repeat the dredging up of material, wherein an extended area is dredged up by both arranging the position of the dredging pole with respect to the vessel and by rotating the vessel about its anchored position.

* * * * *